US007867037B2

(12) United States Patent
Chen

(10) Patent No.: US 7,867,037 B2
(45) Date of Patent: Jan. 11, 2011

(54) ELECTRICAL CONNECTOR WITH TERMINALS RETAINED ON EXTERNAL FACES OF THE HOUSING

(75) Inventor: Zhi-Qiang Chen, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 71 days.

(21) Appl. No.: 12/427,665

(22) Filed: Apr. 21, 2009

(65) Prior Publication Data

US 2009/0305571 A1 Dec. 10, 2009

(30) Foreign Application Priority Data

Jun. 4, 2008 (CN) ..... 2008 2 0037224

(51) Int. Cl.
*H01R 24/04* (2006.01)

(52) U.S. Cl. ..... 439/668

(58) Field of Classification Search ..... 439/607.01, 439/607.35, 669, 668; 385/92, 88
See application file for complete search history.

(56) References Cited

U.S. PATENT DOCUMENTS 7,371,018 B2 * 5/2008 Wang et al. ..... 385/92
7,717,753 B2 * 5/2010 Chen ..... 439/668
2007/0003192 A1 * 1/2007 Wang et al. ..... 385/75
2008/0233805 A1 * 9/2008 Wang et al. ..... 439/668
2009/0269982 A1 * 10/2009 Chen ..... 439/607.41

FOREIGN PATENT DOCUMENTS

TW M267712 6/2005

* cited by examiner

*Primary Examiner*—Chandrika Prasad
(74) *Attorney, Agent, or Firm*—Andrew C. Cheng; Wei Te Chung; Ming Chieh Chang

(57) ABSTRACT

An electrical connector (100) includes an insulative housing (1) and a plurality of contacts exposed and retained to external faces of the housing. The housing defines a front face (11), a receiving cavity (10) opening through the front face for receiving a mating connector and a plurality of retaining holes disposed on external faces thereof. Each of the contacts defines a base portion (211), a contacting portion (2121) extending from one edge of the base portion and projecting into the receiving cavity, at least one retaining portion (213) extending from the base portion and a soldering portion (214). The plurality of contacts are retained to the housing by the at least one retaining portion interfering with the corresponding retaining holes, and all the base portions abut against external faces of the housing.

20 Claims, 8 Drawing Sheets

ELECTRICAL CONNECTOR WITH TERMINALS RETAINED ON EXTERNAL FACES OF THE HOUSING

BACKGROUND OF THE INVENTION

1. Field of the Invention

The present invention relates to an electrical connector, and particularly to an electrical connector with contacts attached at external surfaces of a housing thereof.

2. Description of the Related Art

Taiwan Patent Issued Number M267712 discloses an electrical connector including an insulative housing and a plurality of contacts retained in the housing. The housing defines a receiving cavity running through a mating face thereof for receiving a mating connector therein and a plurality of receiving grooves running through a rear face thereof. The receiving grooves are disposed at two sides of the receiving cavity, and each communicates with the receiving cavity. The contacts are retained in the corresponding receiving grooves. But, most of the conventional electronic products are suitable for miniaturization, and the housing will be small, the receiving grooves disposed in the housing may weaken the rigidity of the housing, so as to cause the housing to be destroyed. Moreover, it is very hard to insert the contacts into the small receiving grooves.

Hence, a new design having an improved housing is provided.

SUMMARY OF THE INVENTION

Accordingly, an object of the present invention is to provide an electrical connector having an improved housing.

In order to achieve the object set forth, an electrical connector includes an insulative housing and a plurality of contacts exposed and retained to external faces of the housing. The housing defines a front face, a receiving cavity opening through the front face for receiving a mating connector and a plurality of retaining holes disposed on external faces thereof. Each of the contacts defines a base portion, a contacting portion extending from one edge of the base portion and projecting into the receiving cavity, at least one retaining portion extending from the base portion and a soldering portion. The plurality of contacts are retained to the housing by the at least one retaining portion interfering with the corresponding retaining holes, and all the base portions abut against external faces of the housing.

Other objects, advantages and novel features of the invention will become more apparent from the following detailed description of the present embodiment when taken in conjunction with the accompanying drawings.

DETAILED DESCRIPTION OF THE INVENTION

Figure 1:
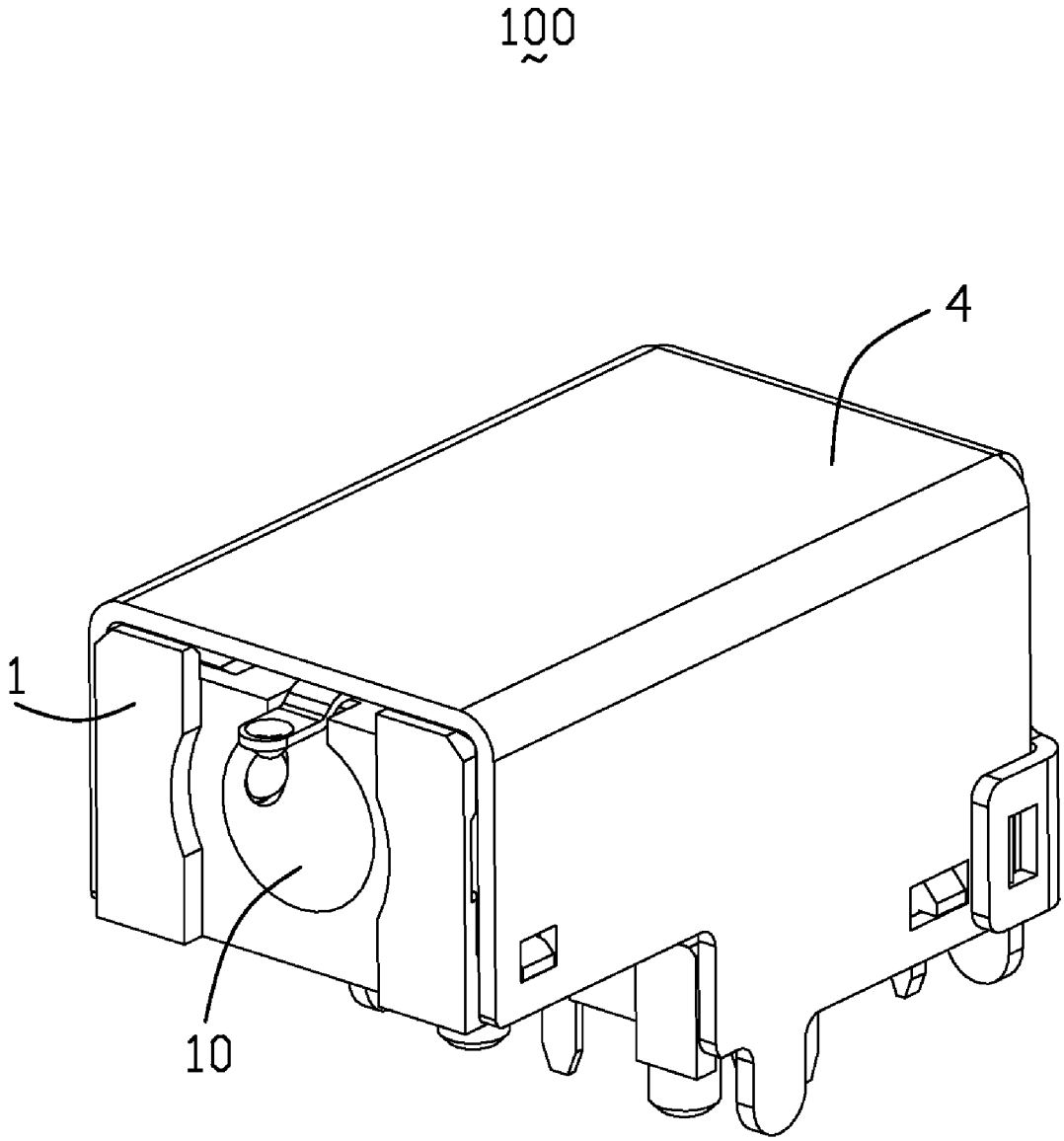
FIG. 1 is a perspective view of an electrical connector in accordance with a preferred embodiment of the present invention.

Reference will now be made to the drawing figures to describe a preferred embodiment of the present invention in detail.

Figure 2:
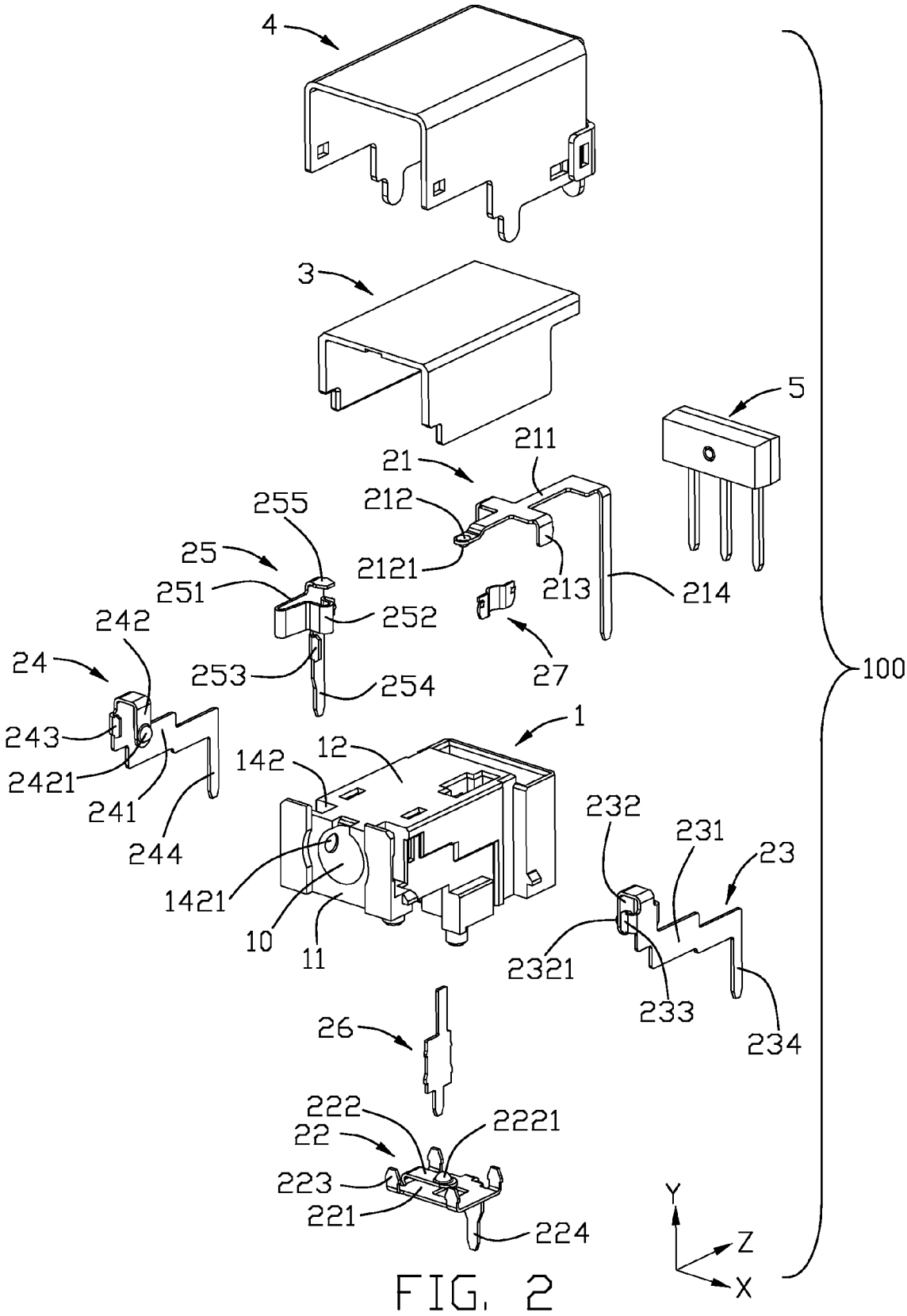
FIG. 2 is an exploded view of the electrical connector shown in FIG. 1.

Referring to FIG. 1 to FIG. 2, an electrical connector 100 described in this preferred embodiment includes an insulative housing 1, a plurality of contacts retained to the housing, a cover 3 covering the housing, a shell 4 covering the housing and the cover 3 and an optical device 5 received in the housing 1. The electrical connector 100 can receive an audio plug connector or optical fiber mating plug connector for achieving a multi-function purpose.

Figure 3:
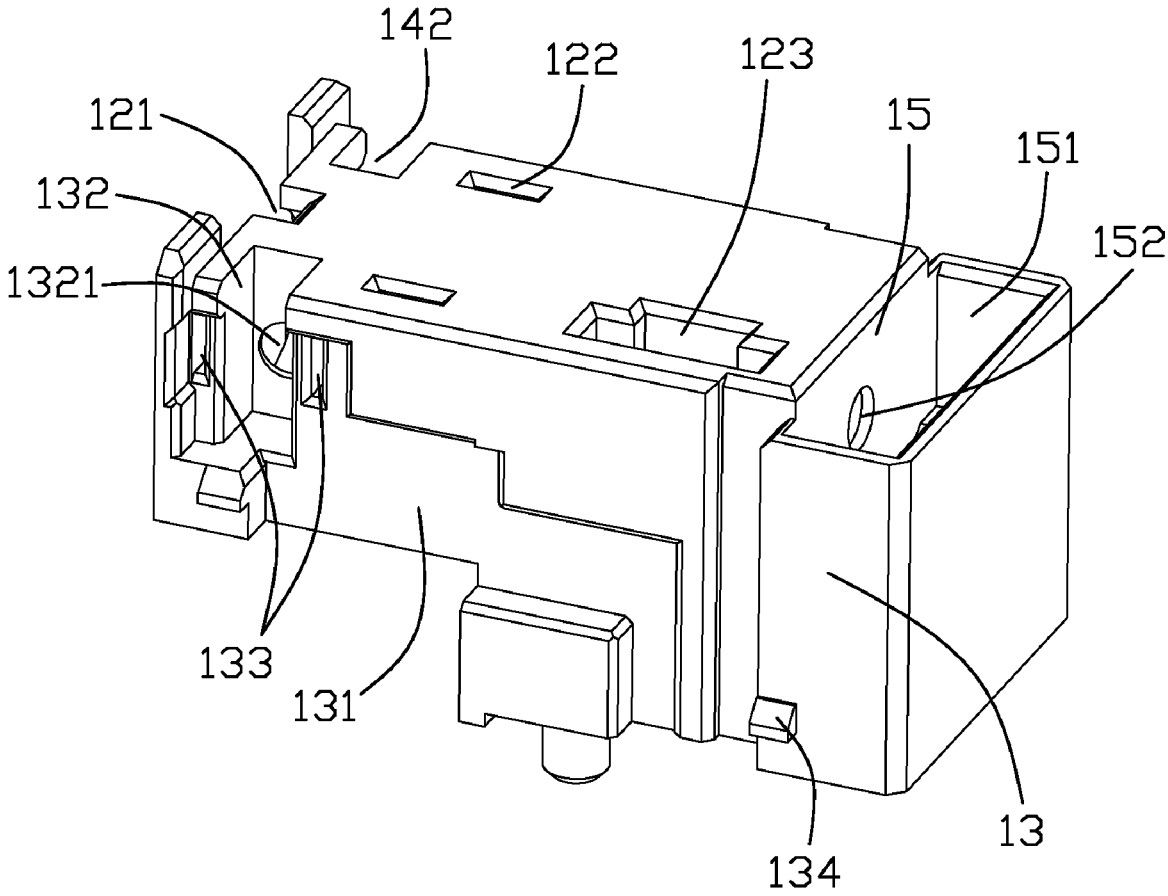
FIG. 3 is a perspective view of an insulative housing shown in FIG. 2.
Figure 4:
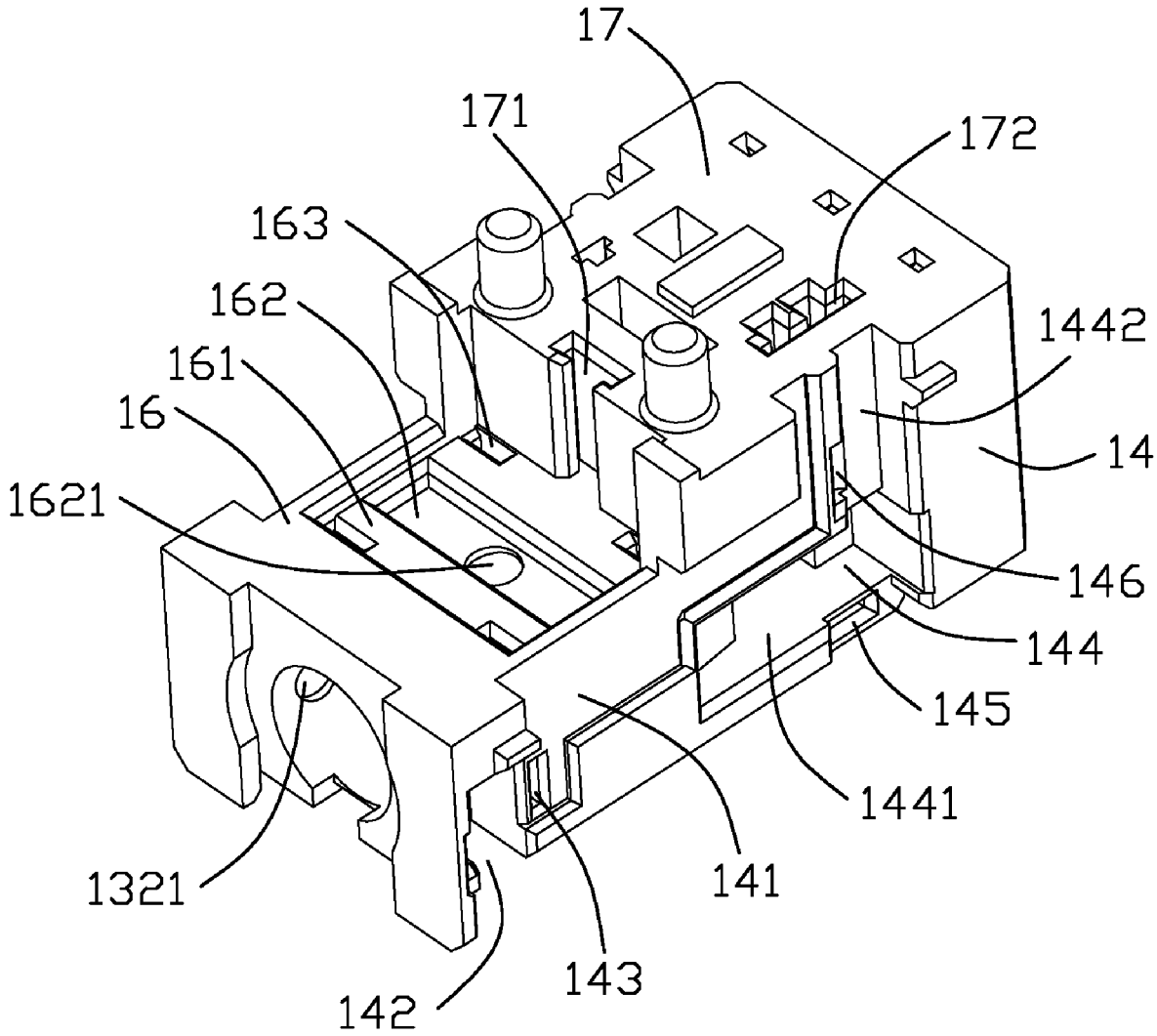
FIG. 4 is another view of the housing shown in FIG. 3.

Referring to FIG. 2 to FIG. 4, the insulative housing 1 defines a front face 11, a rear face opposite to the front face 11, a top wall 12, a bottom wall opposite to the top wall 12 and a pair of sidewalls 13, 14 connecting the top wall 12 with the bottom wall. The front face 11 is defined as a mating face. The housing 1 defines a receiving cavity 10, for receiving a mating connector therein, opening through the mating face along a front-to-back direction ("Z" direction, a mating direction), and a receiving room 151 opening upwards at a rear portion thereof. The top wall 12 defines a gap 121 running through the front face 11 and communicating with the receiving cavity 10 at a middle portion of the front edge, a pair of retaining holes 122 opening upwards and each adjacent to a sidewall, and a receiving hole 123 opening upwards and positioned behind one of the retaining holes 122. The sidewall 13/14 defines a recessed portion 131/141 at a middle portion thereof and a corresponding receiving portion 132/142 in front of the cavity 131/141. The receiving portion 132/142 opens upwards and outwards and further communicating with the corresponding recessed portion 131/141, and a through hole 1321/1421 is provided in an inner wall of the receiving portion 132/142 to communicate the receiving portion 132/142 with the receiving cavity 10 along a second direction ("X" direction) which is vertical to the mating direction. The sidewall 14 further defines a L shaped slot 144 positioned above the receiving portion 142, the slot 144 defines a horizontal first slot 1441 communicating with the receiving cavity 10 and a vertical second slot 1442 extending downwards from a rear edge of the slot 1441.

Referring to FIG. 4, the bottom wall defines a first wall 16 at the front portion thereof and a lower second wall 17 at a rear portion thereof, wherein a step portion is provided therebetween. The first wall 16 defines a rectangular cavity 161 with a deeper room 162 at a middle portion thereof, and four retaining holes 163 symmetrically disposed at four corners of the cavity 161. The room 162 further defines a through hole 1621 at a middle portion thereof to communicate the room 162 with the receiving cavity 10.

Figure 5:
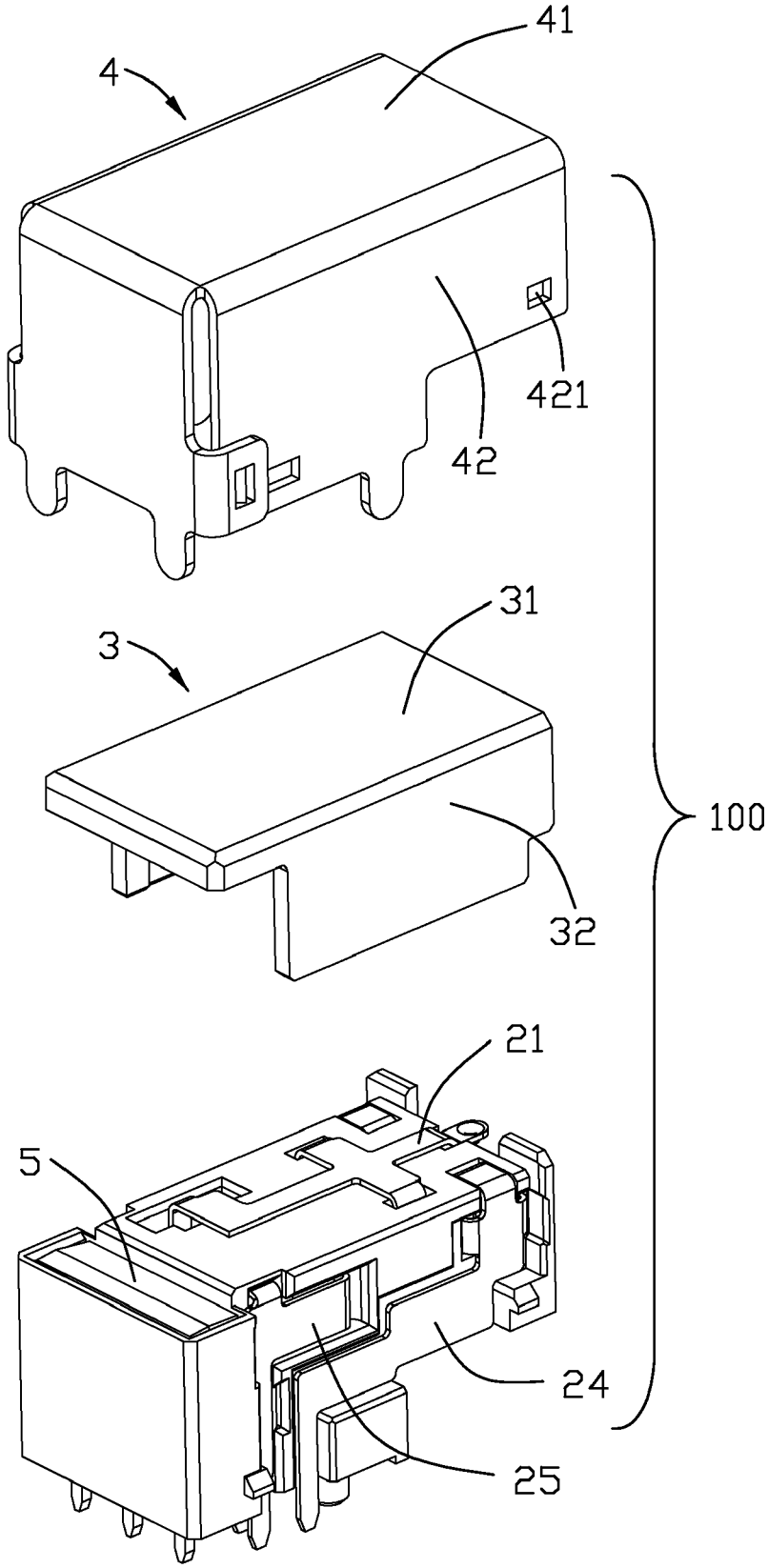
FIG. 5 is a partly exploded view of the electrical connector, showing a shell and a cover separating from the electrical connector.
Figure 6:
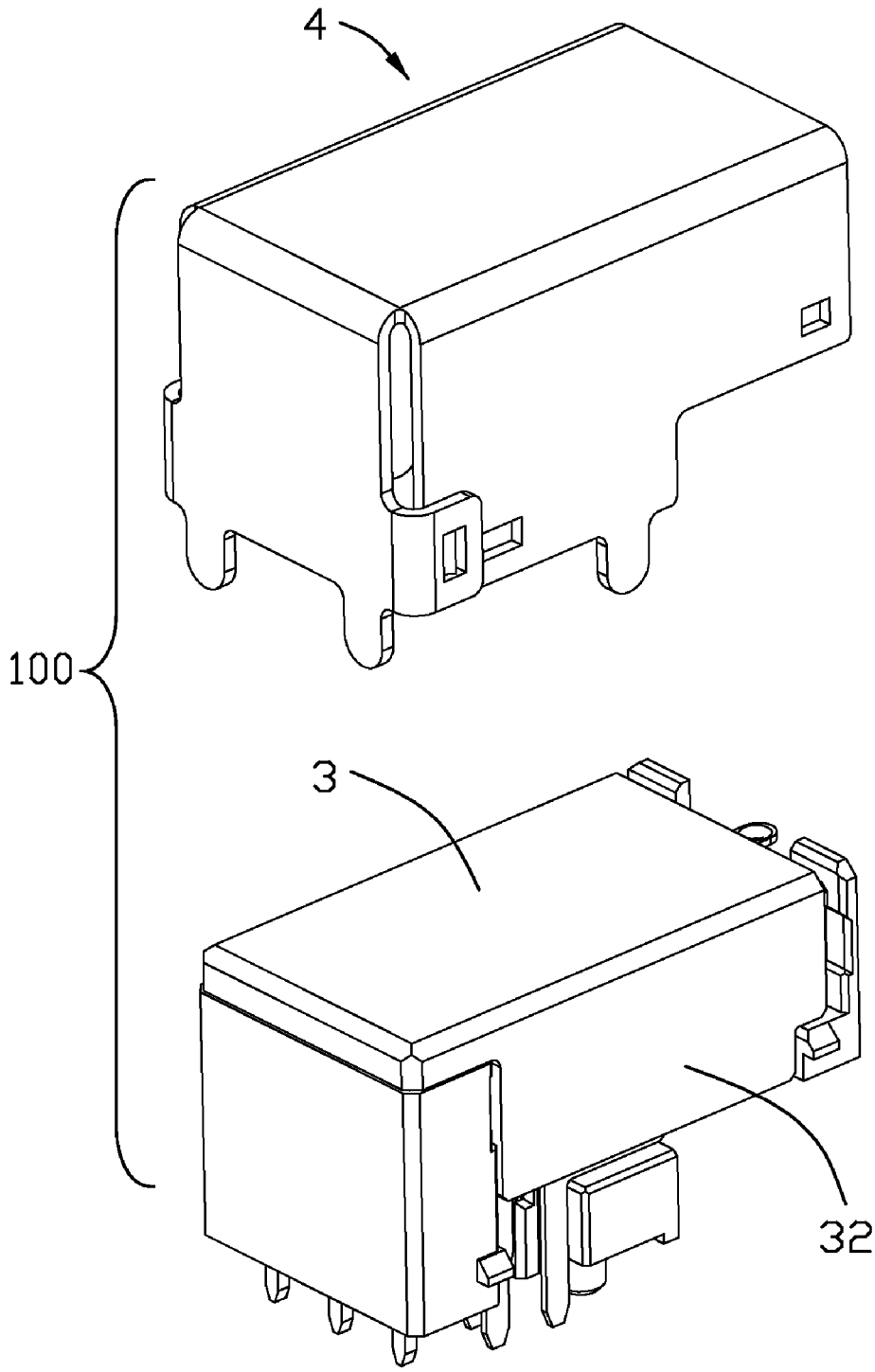
FIG. 6 is another partly exploded view of the electrical connector, showing the shell separating from the electrical connector.

Referring to FIG. 2 and FIG. 5, the plurality of contacts includes a first contact 21, a second contact 22, a third contact 23, a fourth contact 24, and a pair of switch contacts. The first contact 21 defines a flat first base portion 211, a first elastic arm 212 extending forward from the front end of the first base portion 211, and a soldering portion 214 extending downwards from a side edge of the first base portion 211 at a rear end thereof. The first base portion 211 defines a pair of first retaining portions 213 respectively extend downwards from two opposite side edge at the middle portion thereof. The first contact 21 is assembled to the top wall 12 in a top-to-bottom direction ("Y" direction) with the first base portion 211 abutting against an external face of the top wall 12, and the first elastic arm 212 runs through the gap 121 with a first contacting portion 2121 projecting into the receiving cavity 10, the soldering portion 214 is received in the receiving hole 123, and the first retaining portions 213 go into the corresponding retaining holes 122 and engage with the retaining holes 122 to retain the first contact 21 to the housing steadily (shown in FIG. 5).

Figure 7:
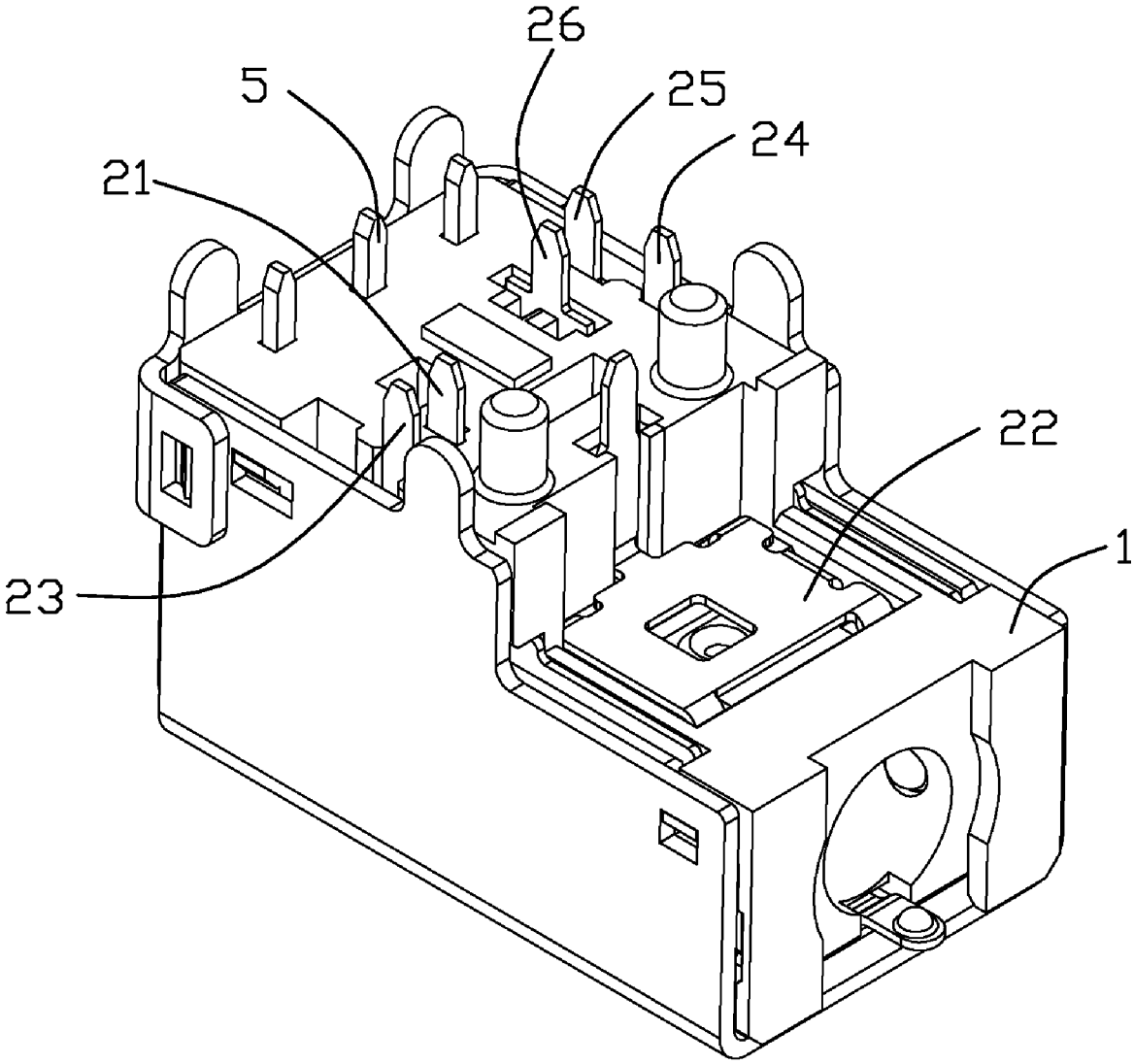
FIG. 7 is another perspective view of the electrical connector shown in FIG. 1.
Figure 8:
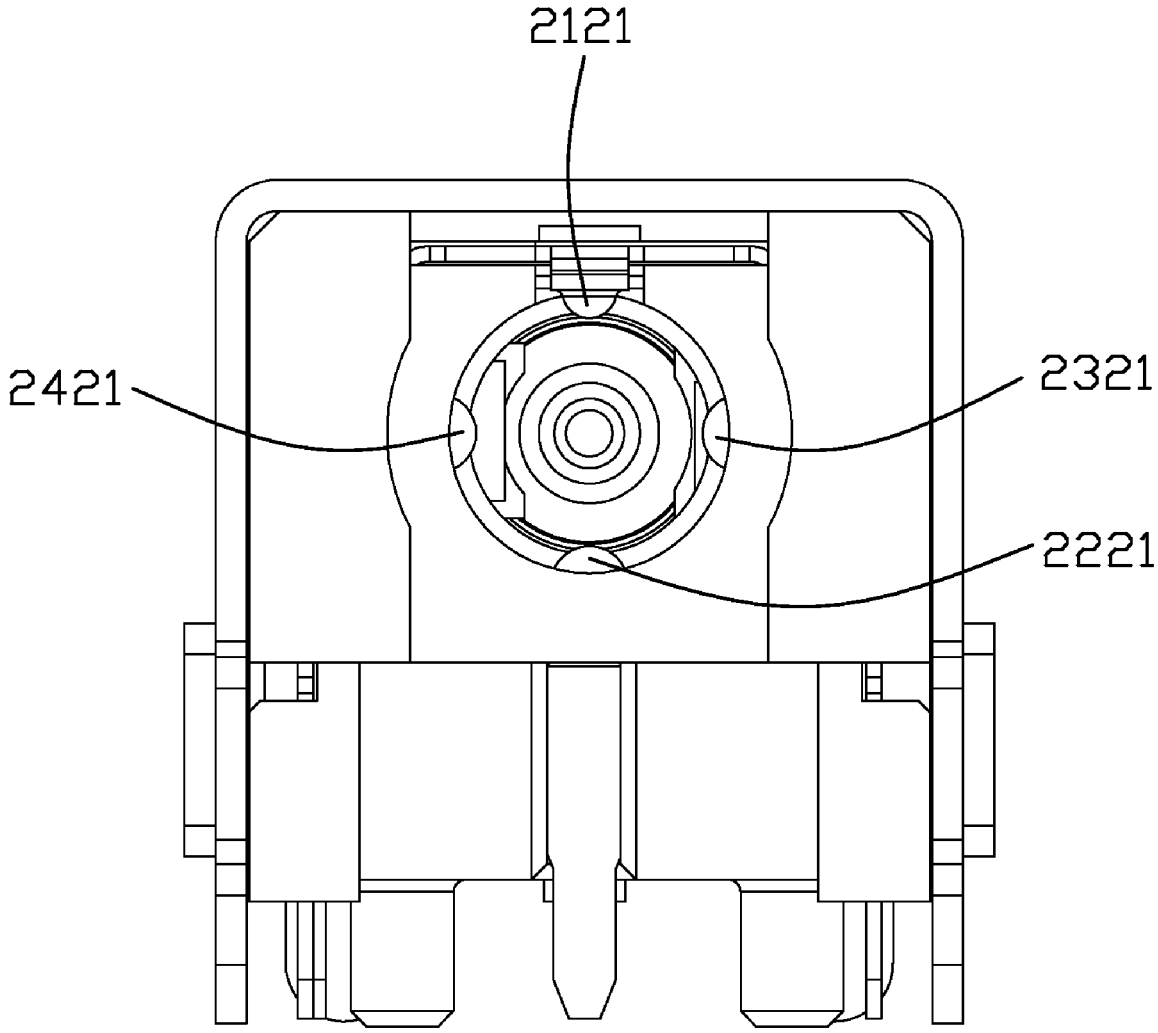
FIG. 8 is a front view of the electrical connector shown in FIG. 1.

The second contacts 22 defines a second rectangular base portion 221, a second elastic arm 222 extending upwards from an end edge of the second base portion 221 at a middle portion thereof and then bending above the second base portion 221, four retaining legs 223 respectively extending upwards from four corners of the second base portion 221, and a soldering portion 224 extending downwards from a side edge of the second base portion 221. The soldering portion 221 is disposed between two adjacent retaining legs 223. The second elastic arm 222 defines a contacting portion 2221 projecting upwards at a free end thereof. The second contact 22 is retained to the first wall 16 of the housing 1 by the retaining legs 223 engaging with the retaining holes 163. The second base portion 221 is received in the cavity 161 and abuts against an external face thereof, and the second elastic arm 222 is received in the room 162 with the second contacting portion 2221 running through the through hole 1621 and projecting into the receiving cavity 10. The soldering portion 224 is retained in a slot 171 provided in front of the second wall 17 (shown in FIG. 7).

The third contact 23 and the fourth contact 24 are of similar configuration, and each defines a vertical flat third/fourth base portion 231/241, a third/fourth elastic arm 232/242 bending downwards to one side of the third/fourth base portion 231/241 from an upper edge thereof, a pair of retaining portions 233/243 extending to the housing along a X direction vertical to the mating direction and the top-to-bottom direction from two opposite side edges of the third/fourth base portion 231/241, and a soldering portion 234/244 extending downwards from the corresponding third/fourth base portion 231/241. The elastic arm 232/242 defines a third contacting portion 2321/2421 extending outwards. The third contact 23 and the fourth contact 24 are respectively assembled to the corresponding recessed portions 131, 141 along the X direction. The third base portion 231 is received in the recessed portion 131 and abuts against an external face of the sidewall 13, and the third elastic arm 232 runs into the receiving portion 132 with the third contacting portion 2321 projecting into the receiving cavity 10 through the through hole 1321. The retaining portions 233 are inserted into retaining slots 133 provided at two sides of the receiving portion 132 to retain the third contact 23 to the housing 1 steadily. The fourth contact 24 is retained in the recessed portion 141 by the retaining portions 243 engaging with the corresponding retaining slots 143, and the fourth base portion 241 abuts against an external face of the sidewall 14, the fourth elastic arm 242 runs into the receiving portion 142, and the fourth contacting portion 2421 projects into the receiving cavity 10 through the through hole 1421.

The pair of switch contacts includes an elastic contact 25 and an immovable contact 26. The elastic contact 25 defines a flat fifth base portion 251, a fifth elastic arm 252 bending backward from a front edge of the fifth base portion 251, and a soldering portion 254 extending downwards from a lower edge of the fifth base portion 251. The fifth base portion 251 defines a retaining portion 255 bending along the X direction from an upper edge thereof, the soldering portion 254 defines a retaining portion 253 extending from a front edge thereof. The elastic contact 25 is assembled to the sidewall 14 along the X direction, and the fifth base portion 251 is retained to the slot 144 and abuts against an external face of the housing 1. The fifth elastic arm 252 is received in the first slot 1441 and partly projects into the receiving cavity 10. The retaining portions 253, 255 engage with corresponding retaining slots 146, 145 to retain the elastic contact 25 to the sidewall 14 steadily. The immovable contact 26 is inserted into a retaining hole 172 provided at the second wall 17 upwards from the bottom wall, and the fifth elastic arm 252 contacts the immovable contact 26. An audio plug connector which is inserted into the receiving cavity 10 may separate the elastic contact 25 from the immovable contact 26. A retaining member 27 is downwards inserted into the receiving hole 123 from the top wall of the housing 1, which can retain the audio plug connector received in the receiving cavity 10 steadily.

Referring to FIG. 5 to FIG. 8, the optical device 5 is downwards received in the receiving room 151 from the top wall 12. The receiving room 151 communicates with the receiving cavity 10 by a through hole 152 provided at a board portion 15 which is disposed between the receiving cavity 10 and the receiving room 151, and an optical fiber mating plug connector (not shown) may connect with the optical device 5 by the through hole 152. The cover 3 defines a top wall 31 and a pair of opposite sidewalls 32 extending downwards from two side edges of the top wall 31. The top wall 31 covers the top wall 12 of the housing 1 with the first contact 21 retained therebetween, and the sidewalls 32 covers the middle portion of the sidewalls 13, 14 of the housing 1 to retain the base portions 231, 241, 251 therebetween. The shell 4 is assembled to the housing along the Y direction, the top piece 41 covers the top wall 31 of the housing 1, and the side pieces 42 are retained outside of the sidewalls 13, 14 of housing 1 by the retaining holes 421 engaging with the protrusions 134. The contacts 21, 22, 23, 24, 25 are respectively retained on the external faces of the housing 1 instead of being retained in the slots disposed in the housing, which can enhance the rigidity of the housing 1. Moreover, the assemblage of the contacts will be more easily. The contacting portions 2121, 2221, 2321, 2421 of the contacts are exposed at a circumference of the receiving cavity 10 (shown in FIG. 8).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a front face, a receiving cavity opening through the front face for receiving a mating connector and a plurality of retaining holes disposed on external faces of the housing; and a plurality of contacts exposed and retained to the external faces of the housing, each of the contacts defining a base portion, a contacting portion extending from one edge of the base portion and projecting into the receiving cavity, at least one retaining portion extending from the base portion and a soldering portion;

wherein the plurality of contacts are retained to the housing by the at least one retaining portion interfering with the corresponding retaining holes, and all the base portions abut against the external faces of the housing.

2. The electrical connector as described in claim 1, wherein the housing defines a top wall, a bottom wall opposite to the top wall and a pair of sidewalls connecting with the top wall and the bottom wall, the plurality of contacts includes a first contact abutting against an external face of the top wall, a second contact abutting against an external face of the bottom wall, and a third and fourth contacts each abutting against a corresponding external face of the sidewalls.

3. The electrical connector as described in claim 2, wherein the external faces of the bottom wall and the sidewalls each defines a recessed portion and a receiving portion extending from the recessed portion and communicating with the receiving cavity, and the second, third and fourth contacts are respectively received in the recessed portions.

4. The electrical connector as described in claim 3, wherein the second, third and fourth contacts each define an elastic arm, the contacting portion is defined at a free end of the elastic arm, the base portion is received in the recessed portion, and the elastic arm is received in the receiving portion.

5. The electrical connector as described in claim 4, wherein the contacting portions expose at a circumference of the receiving cavity.

6. The electrical connector as described in claim 1, wherein the plurality of contacts includes an elastic contact which is retained to the housing with a base portion thereof abutting against an external face of the sidewall.

7. The electrical connector as described in claim 1, further comprising a cover covering on the housing, and wherein the plurality of contacts are disposed between the external faces of housing and the cover.

8. The electrical connector as described in claim 1, further comprising an optical device at a rear portion thereof enabling the electrical connector to receive a selected one of an audio plug connector and an optical fiber mating plug connector.

9. An electrical connector comprising:

an insulating housing defining a mating face, a receiving cavity opening through the mating face thereof; and a plurality of contacts retained to the housing, each of the contacts defining a base portion, a contacting portion extending from the base portion and projecting into the receiving cavity to contact with a mating connector, at least one retaining portion extending from the base portion and a soldering portion;

wherein the contacts are retained around external faces of the housing instead of being inserted into the housing by the at least one retaining portion engaging with the housing.

10. The electrical connector as described in claim 9, wherein the housing defines a plurality of retaining holes at external faces thereof, the contacts are retained to the external faces by the at least one retaining portion engaging with the retaining holes.

11. The electrical connector as described in claim 9, wherein the contacting portions expose at a circumference of the receiving cavity.

12. The electrical connector as described in claim 9, wherein the electrical connector further defines an optical device at a rear portion thereof, the electrical connector can receive an audio plug connector or optical fiber mating plug connector for achieving a multi-function purpose.

13. An electrical connector comprising:

an insulative housing defining a plurality of side exterior faces surrounding a plug receiving cavity;

a plurality of through holes defined in said side exterior faces, respectively, and communicating with the plug receiving cavity;

a plurality of contacts disposed upon said side exterior faces, respectively, with corresponding contacting portions extending through the through holes and exposed in the plug receiving cavity, respectively; and an insulative cover covering said exterior faces so as to cooperate with the housing to sandwich the corresponding contacts therebetween in a radial direction.

14. The electrical connector as claimed in claim 13, wherein a metallic shell covers said insulative cover.

15. The electrical connector as claimed in claim 14, wherein said cover is fastened to the housing via said shell is fixed to the housing.

16. The electrical connector as claimed in claim 13, further including another contact sandwiched between the cover and the housing with a contacting portion extending forward beyond a front face of the housing and in front of the plug receiving cavity.

17. The electrical connector as claimed in claim 13, wherein each of said contacts further includes a retention section to fix the corresponding contact to the housing disregarding whether or not said contact is sandwiched between the housing and the cover.

18. The electrical connector as claimed in claim 13, wherein each of said contacts are assemble toward the corresponding side exterior face in a direction perpendicular to said corresponding side exterior.

19. The electrical connector as claimed in claim 13, wherein each of said side exterior face defines a cavity to receive a planar main body of the corresponding contact.

20. The electrical connector as claimed in claim 13, where said plug receiving cavity is of a columnar type, and the contacting portions are of a spherical shaped form on a corresponding elastic arm.

* * * * *